US011578375B2

(12) United States Patent
Yamazaki et al.

(10) Patent No.: US 11,578,375 B2
(45) Date of Patent: Feb. 14, 2023

(54) HIGH-STRENGTH HOT-ROLLED STEEL SHEET AND METHOD FOR MANUFACTURING THE SAME

(71) Applicant: JFE STEEL CORPORATION, Tokyo (JP)

(72) Inventors: Kazuhiko Yamazaki, Tokyo (JP); Shunsuke Toyoda, Tokyo (JP); Noriaki Moriyasu, Tokyo (JP); Kentaro Irisa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 0 days.

(21) Appl. No.: 15/747,583

(22) PCT Filed: Jul. 20, 2016

(86) PCT No.: PCT/JP2016/003396
§ 371 (c)(1),
(2) Date: Jan. 25, 2018

(87) PCT Pub. No.: WO2017/017933
PCT Pub. Date: Feb. 2, 2017

(65) Prior Publication Data

US 2018/0237874 A1 Aug. 23, 2018

(30) Foreign Application Priority Data

Jul. 27, 2015 (JP) ..... JP2015-147454
Feb. 17, 2016 (JP) ..... 2016-027728

(51) Int. Cl.

| | |
|---|---|
| ***C21D 8/02*** | (2006.01) |
| ***C21D 9/46*** | (2006.01) |
| ***C22C 38/38*** | (2006.01) |
| ***C22C 38/00*** | (2006.01) |
| ***C22C 38/06*** | (2006.01) |
| ***C22C 38/28*** | (2006.01) |
| ***C22C 38/32*** | (2006.01) |
| ***C22C 38/60*** | (2006.01) |
| ***C22C 38/20*** | (2006.01) |
| ***C22C 38/22*** | (2006.01) |
| ***C22C 38/24*** | (2006.01) |
| ***C22C 38/26*** | (2006.01) |

(Continued)

(52) U.S. Cl.
CPC ..... *C21D 8/0226* (2013.01); *C21D 8/0263* (2013.01); *C21D 9/46* (2013.01); *C22C 38/00* (2013.01); *C22C 38/001* (2013.01); *C22C 38/02* (2013.01); *C22C 38/04* (2013.01); *C22C 38/06* (2013.01); *C22C 38/20* (2013.01); *C22C 38/22* (2013.01); *C22C 38/24* (2013.01); *C22C 38/26* (2013.01); *C22C 38/28* (2013.01); *C22C 38/32* (2013.01); *C22C 38/34* (2013.01); *C22C 38/38* (2013.01); *C22C 38/40* (2013.01); *C22C 38/60* (2013.01); *C21D 2211/001* (2013.01); *C21D 2211/002* (2013.01); *C21D 2211/004* (2013.01); *C21D 2211/005* (2013.01); *C21D 2211/008* (2013.01)

(58) Field of Classification Search
CPC ..... C21D 8/0226; C21D 8/0263; C21D 9/46; C21D 2211/001; C21D 2211/002; C21D 2211/004; C21D 2211/005; C21D 2211/008; C22C 38/00; C22C 38/001; C22C 38/02; C22C 38/04; C22C 38/06; C22C 38/20; C22C 38/22; C22C 38/24; C22C 38/26; C22C 38/28; C22C 38/32; C22C 38/34; C22C 38/38; C22C 38/40; C22C 38/60
See application file for complete search history.

(56) References Cited

U.S. PATENT DOCUMENTS 6,364,968 B1 * 4/2002 Yasuhara ..... C21D 1/20 148/320
2012/0247625 A1 10/2012 Shimamura et al.
(Continued)

FOREIGN PATENT DOCUMENTS

CN 103882320 A 6/2014
CN 105102662 A 11/2015
(Continued)

OTHER PUBLICATIONS

Dec. 11, 2019 Office Action issued in Chinese Patent Application No. 201680044137.4.
(Continued)

*Primary Examiner* — Robert S Jones, Jr.
*Assistant Examiner* — Jiangtian Xu
(74) *Attorney, Agent, or Firm* — Oliff PLC

(57) ABSTRACT

A high-strength hot-rolled steel sheet that has excellent punching workability and hole expandability, and a method for manufacturing the same. The hot-rolled steel sheet has a tensile strength of 980 MPa or more. The hot-rolled steel sheet has a chemical composition containing C, Si, Mn, P, S, Al, N, Ti, Cr, and B, and has a microstructure including a bainite phase having an area ratio of 85% or more as a main phase, and a martensite phase or martensite-austenite constituent having an area ratio of 15% or less as a second phase, the balance being a ferrite phase. The second phase has an average grain diameter of 3.0 μm or less, prior-austenite grains have an average aspect ratio of 1.3 or more and 5.0 or less, and recrystallized prior-austenite grains have an area ratio of 15% or less relative to non-recrystallized prior-austenite grains.

4 Claims, No Drawings

(51) Int. Cl.

| | |
|---|---|
| ***C22C 38/02*** | (2006.01) |
| ***C22C 38/40*** | (2006.01) |
| ***C22C 38/04*** | (2006.01) |
| ***C22C 38/34*** | (2006.01) |

(56) References Cited

U.S. PATENT DOCUMENTS

| | | | | |
|---|---|---|---|---|
| 2016/0076124 | A1 | 3/2016 | Yamazaki et al. | |
| 2016/0289788 | A1 | 10/2016 | Shibata et al. | |
| 2018/0057905 | A1 | 3/2018 | Ota et al. | |
| 2018/0237874 | A1 * | 8/2018 | Yamazaki | C22C 38/20 |

FOREIGN PATENT DOCUMENTS

| | | | | |
|---|---|---|---|---|
| EP | 2559783 | A1 * | 2/2013 | C21D 8/0226 |
| EP | 2 987 887 | A1 | 2/2016 | |
| JP | 2000-109951 | A | 4/2000 | |
| JP | 2002-180190 | A | 6/2002 | |
| JP | 2004-315857 | A | 11/2004 | |
| JP | 2005-120437 | A | 5/2005 | |
| JP | 2008-69425 | A | 3/2008 | |
| JP | 2009-084637 | A | 4/2009 | |
| JP | 2012-012701 | A | 1/2012 | |
| WO | 2011/152541 | A1 | 12/2011 | |
| WO | 2014/051005 | A1 | 4/2014 | |
| WO | 2014/171062 | A1 | 10/2014 | |
| WO | 2015/129199 | A1 | 9/2015 | |

OTHER PUBLICATIONS

Jun. 14, 2019 Office Action issued in Chinese Patent Application No. 201680044137.4.
Dec. 21, 2018 Office Action issued in Chinese Patent Application No. 201680044137.4.
Jul. 17, 2019 Office Action issued in Korean Patent Application No. 10-2018-7001646.
Oct. 4, 2016 Search Report issued in International Patent Application No. PCT/JP2016/003396.
Jun. 5, 2020 Office Action issued in Chinese Patent Application No. 201680044137.4.
Feb. 5, 2018 Extended Search Report issued in European Patent Application No. 16830039.0.
Sep. 19, 2017 Office Action issued in Japanese Patent Application No. 2016-567062.
Oct. 5, 2021 Office Action issued in U.S. Appl. No. 17/262,975.
Jun. 16, 2021 Office Action issued in U.S. Appl. No. 17/262,975.
Mar. 17, 2022 Office Action issued in U.S. Appl. No. 17/262,975.
May 26, 2022 Office Action issued in Chinese Patent Application No. 201680044137.4.
Nov. 28, 2022 Office Action issued in Chinese Patent Application No. 201680044137.4.

* cited by examiner

HIGH-STRENGTH HOT-ROLLED STEEL SHEET AND METHOD FOR MANUFACTURING THE SAME

TECHNICAL FIELD

The present disclosure relates to a high-strength hot-rolled steel sheet having a tensile strength TS of 980 MPa or more, the steel sheet being suitable for automobile structural members, automobile skeleton members, automobile suspension system members such as suspensions, and frame parts of trucks; and a method for manufacturing the high-strength hot-rolled steel sheet.

BACKGROUND ART

In recent years, from the viewpoint of preservation of the global environment, regulations on emission of exhaust gas from automobiles have been tightened. Thus, an increase in the fuel efficiency of automobiles has become an important issue. Accordingly, there has been a demand for materials used therefor that have an even higher strength and an even smaller thickness. With this demand, as materials for automobile parts, high-strength hot-rolled steel sheets have often been used. Such high-strength hot-rolled steel sheets are used not only for automobile structural members and automobile skeleton members, but also for automobile suspension system members, frame parts of trucks, and the like.

As described above, there has been an increase, year after year, in the demand for high-strength hot-rolled steel sheets having certain strengths as materials of automobile parts. In particular, high-strength hot-rolled steel sheets having a tensile strength TS of 980 MPa or more are highly expected as materials that enable a considerable increase in the fuel efficiency of automobiles.

On the other hand, in particular, for suspension system parts of automobiles provided often by punching and burring, there has been a demand for a steel sheet that has excellent punching workability and hole expandability. However, an increase in the strength of steel sheets results in, in general, degradation of the punching workability and the hole expandability. Thus, in order to obtain a high-strength hot-rolled steel sheet that has excellent punching workability and hole expandability, various studies have been performed.

For example, Patent Literature 1 proposes a hot-rolled steel sheet that has a composition containing, by mass %, C: 0.01% or more and 0.10% or less, Si: 2.0% or less, Mn: 0.5% or more and 2.5% or less, and further one or more (in total, in the amount of 0.5% or less) selected from V: 0.01% or more and 0.30% or less, Nb: 0.01% or more and 0.30% or less, Ti: 0.01% or more and 0.30% or less, Mo: 0.01% or more and 0.30% or less, Zr: 0.01% or more and 0.30% or less, and W: 0.01% or more and 0.30% or less, and has a microstructure in which the area ratio of bainite is 80% or more, the average grain diameter r (nm) of precipitates satisfies $r \geq 207/\{27.4X(V)+23.5X(Nb)+31.4X(Ti)+17.6X(Mo)+25.5X(Zr)+23.5X(W)\}$ (X(M) (M: V, Nb, Ti, Mo, Zr, or W) represents the average atomic weight ratio of each element forming precipitates, X(M)=(mass % of M/atomic weight of M)/(V/51+Nb/93+Ti/48+Mo/96+Zr/91+W/184), and the average grain diameter r and the fraction f of precipitates satisfy $r/f \leq 12000$.

Patent Literature 1 also proposes a method for manufacturing a hot-rolled steel sheet that has the above-described microstructure in which a steel material having the above-described composition is heated, subjected to hot rolling at a finish rolling temperature of 800° C. or more and 1050° C. or less, subsequently subjected to rapid cooling at 20° C./s or more to a temperature range (range of 500° C. to 600° C.) in which bainite transformation and precipitation concurrently occur, to coiling at 500° C. to 550° C., subsequently to holding at a cooling rate of 5° C./h or less (including 0° C./h) for 20 h or more. According to the technique proposed in Patent Literature 1, a steel sheet is provided such that the microstructure mainly includes bainite, bainite is subjected to precipitation strengthening with a carbide of V, Ti, Nb, or the like, and the size of precipitates is appropriately controlled (appropriately providing coarse precipitates), to thereby provide a high-strength hot-rolled steel sheet that is excellent in stretch-flanging properties and fatigue properties.

Patent Literature 2 states that a steel sheet that contains, by mass %, C: 0.01% to 0.20%, Si: 1.5% or less, Al: 1.5% or less, Mn: 0.5% to 3.5%, P: 0.2% or less, S: 0.0005% to 0.009%, N: 0.009% or less, Mg: 0.0006% to 0.01%, O: 0.005% or less, and one or two selected from Ti: 0.01% to 0.20% and Nb: 0.01% to 0.10%, the balance being iron and inevitable impurities, that satisfies all the three formulas below, and that has a steel microstructure mainly including a bainite phase, provides a high-strength steel sheet that has a tensile strength of 980 N/mm$^2$ or more and is excellent in hole expandability and ductility.

$$[Mg\ \%] \geq ([0\%]/16 \times 0.8) \times 24 \quad (1)$$

$$[S\ \%] \leq ([Mg\ \%]/24 - [0\%]/16 \times 0.8 + 0.00012) \times 32 \quad (2)$$

$$[S\ \%] \leq 0.0075/[Mn\ \%] \quad (3)$$

Patent Literature 3 proposes a hot-rolled steel sheet that has a composition containing, by mass %, C: 0.01% to 0.08%, Si: 0.30% to 1.50%, Mn: 0.50% to 2.50%, P 0.03%, S 0.005%, and one or two selected from Ti: 0.01% to 0.20% and Nb: 0.01% to 0.04%, and has a ferrite-bainite dual-phase microstructure having 80% or more of ferrite having a grain diameter of 2 μm or more. According to the technique proposed in Patent Literature 3, the ferrite-bainite dual-phase microstructure is provided and ferrite crystal grains are provided so as to have a grain diameter of 2 μm or more, to thereby improve the ductility without degradation of the hole expandability, to thereby provide a high-strength hot-rolled steel sheet that has a strength of 690 N/mm$^2$ or more and is excellent in hole expandability and ductility.

Patent Literature 4 proposes a hot-rolled steel sheet that has a composition containing, by mass %, C: 0.05% to 0.15%, Si: 0.2% to 1.2%, Mn: 1.0% to 2.0%, P: 0.04% or less, S: 0.005% or less, Ti: 0.05% to 0.15%, Al: 0.005% to 0.10%, and N: 0.007% or less in which the amount of solid solute Ti is 0.02% or more, and that has a microstructure constituted by a single phase of a bainite phase having an average grain diameter of 5 μm or less. According to the technique proposed in Patent Literature 4, a steel sheet is provided so as to have a microstructure constituted by a single phase of a fine bainite phase, and so as to contain 0.02% or more of solid solute Ti, to thereby provide a high-strength hot-rolled steel sheet that has a tensile strength TS of 780 MPa or more and is excellent in stretch-flanging properties and fatigue resistance.

Regarding improvement in punching workability, for example, Patent Literature 5 proposes a high-strength hot-rolled steel sheet that has a composition containing, by mass %, C: 0.01% to 0.07%, N: 0.005% or less, S: 0.005% or less, Ti: 0.03% to 0.2%, and B: 0.0002% to 0.002%, that has a microstructure including ferrite or bainitic ferrite as a main phase, and including a hard second phase and cementite in an area ratio of 3% or less, and that is excellent in punching workability. According to the technique described in Patent Literature 5, B is held in a solid solution state to thereby prevent defects in punched edges.

CITATION LIST

Patent Literature

PTL 1: Japanese Unexamined Patent Application Publication No. 2009-84637

PTL 2: Japanese Unexamined Patent Application Publication No. 2005-120437

PTL 3: Japanese Unexamined Patent Application Publication No. 2002-180190

PTL 4: Japanese Unexamined Patent Application Publication No. 2012-12701

PTL 5: Japanese Unexamined Patent Application Publication No. 2004-315857

SUMMARY

Technical Problem

However, the technique proposed in Patent Literature 1 is required to have a process of coiling a steel sheet at 500° C. to 550° C. and holding it at a cooling rate of 5° C./h or less for 20 h or more in order to generate precipitates having sizes on the order of nanometers in a bainite phase. The hot-rolled steel sheet produced by this technique cannot have excellent punching workability, which is problematic.

In the technique disclosed in Patent Literature 2, in order to improve the ductility of a hot-rolled steel sheet, a hot-rolled steel sheet after finish rolling is subjected to air cooling at an air cooling start temperature of 650° C. to 750° C., to thereby generate a ferrite structure in which precipitation strengthening is achieved with precipitates having a size of less than 20 nm. However, the hot-rolled steel sheet produced by this technique also cannot have excellent punching workability.

In the technique proposed by Patent Literature 3, a ferrite-bainite dual-phase microstructure is formed so as to include 80% or more of ferrite having a grain diameter of 2 μm or more. Thus, the resultant steel sheet strength is about 976 MPa at the most, and a further increase in the strength to a tensile strength TS of 980 MPa or more is difficult to achieve. If such a steel sheet is provided so as to have a high strength of a tensile strength TS of 980 MPa or more, it cannot have excellent punching workability.

According to the technique proposed in Patent Literature 4, a hot-rolled steel sheet is provided that has a tensile strength TS of 780 MPa or more and is excellent in stretch-flanging properties. However, in order to further increase the strength to achieve a high strength that is a tensile strength TS of 980 MPa or more, the C content needs to be increased. With such an increase in the C content, it becomes difficult to control the amount of Ti carbide precipitated. Thus, it becomes difficult to stably maintain 0.02% or more of solid solute Ti, which is necessary for improving the stretch-flanging properties of the steel sheet. This results in degradation of the stretch-flanging properties.

In the technique proposed by Patent Literature 5, a steel sheet is strengthened by precipitation strengthening of ferrite or bainitic ferrite, and the resultant steel-sheet strength is about 833 MPa. In order to make this steel sheet so as to have a tensile strength TS of 980 MPa or more, a precipitation-strengthening element such as Ti, V, Nb, or Mo needs to be further added. In that case, a steel sheet cannot be obtained that has a tensile strength TS of 980 MPa or more and excellent punching workability.

In summary, the related art has not established a technique of providing a hot-rolled steel sheet that has excellent punching workability and hole expandability while still having a high strength of a tensile strength TS of 980 MPa or more.

Accordingly, an object of the present disclosure is to address such problems in the related art and to provide a high-strength hot-rolled steel sheet that has excellent punching workability and hole expandability while still having a high strength of a tensile strength TS of 980 MPa or more; and a method for manufacturing the high-strength hot-rolled steel sheet.

Solution to Problem

In order to achieve the object, the inventors of the present disclosure performed thorough studies on how to provide a hot-rolled steel sheet that has improved punching workability and hole expandability while still having a high strength of a tensile strength TS of 980 MPa or more. As a result, the inventors have found the following findings: by controlling the average aspect ratio of prior-austenite grains after completion of finish rolling and the area ratio of prior-austenite grains recrystallized after completion of finish rolling, by providing a bainite phase as a main phase, and, if present, by controlling the fraction and grain diameter of a martensite or martensite-austenite constituent as a second phase structure, the hot-rolled steel sheet has considerably improved hole expandability while still having a high strength of a tensile strength TS of 980 MPa or more. In addition, the inventors have newly found that, by controlling the amount of precipitates having a diameter of 20 nm or less in a hot-rolled steel sheet, the punching workability is considerably improved.

Incidentally, the term "bainite phase" used herein means a microstructure that includes lath-like bainitic ferrite and Fe-based carbide between the bainitic ferrite and/or inside the bainitic ferrite (within bainitic ferrite grains) (cases of no precipitation of Fe-based carbide are also included). Unlike polygonal ferrite, bainitic ferrite has a lath-like shape and has a relatively high dislocation density within laths. For this reason, polygonal ferrite and bainitic ferrite can be distinguished from each other with a SEM (scanning electron microscope) or a TEM (transmission electron microscope). The martensite or martensite-austenite constituent, which looks bright in SEM images in contrast to the bainite phase or polygonal ferrite, can also be distinguished with a SEM.

In general, when strain is introduced into prior-austenite grains to cause bainite transformation, the strain introduced in the prior-austenite grains is inherited in the bainite phase. This results in an increase in the dislocation density of the bainite structure, which results in an increase in the strength of the steel sheet. The inventors of the present disclosure performed additional studies and have newly found the following findings: Si and B are added at the same time and strain is introduced into prior-austenite grains to cause bainite transformation, to thereby provide a steel sheet that has a markedly high strength and excellent hole expandability. The mechanism responsible for this is not necessarily clear, but is presumed as follows: addition of Si causes a decrease in stacking fault energy, which enables formation of dislocation cells after bainite transformation to maintain a high dislocation density, to thereby achieve a high strength.

Furthermore, addition of B causes segregation of B in prior-austenite grain boundaries and a decrease in grain boundary energy, to suppress ferrite transformation and form a uniform bainite structure, which presumably results in improvement in the hole expandability.

In addition, the following findings have been newly found: when prior-austenite grains are recrystallized after completion of finish rolling, strain is not introduced into austenite grains, which results in a decrease in the strength of the bainite phase after transformation. In addition, B cannot segregate in recrystallized prior-austenite grain boundaries, and ferrite transformation may occur during cooling after completion of finish rolling, which results in generation of a difference in strength between a bainite phase as a main phase and a ferrite phase; and, in a hole expanding test, macroscopic strain is concentrated at the interface between the ferrite phase and the bainite phase, so that excellent hole expandability cannot be provided.

In addition, an excessively high aspect ratio of prior-austenite grains results in occurrence of separation during punching and degradation of punching workability.

In addition, in general, the following is known: when a martensite phase or a martensite-austenite constituent as a hard second phase structure is present in a bainite phase as a main phase, macroscopic stress concentration occurs at the interface between the main phase and the second phase during a hole expanding test, which results in degradation of hole expandability. Accordingly, the inventors of the present disclosure performed additional studies and have newly found the following findings: by controlling the grain diameter of the second phase structure so as to be very small, macroscopic stress concentration does not occur, and degradation of hole expandability does not occur.

On the other hand, in order to obtain high-strength hot-rolled steel sheets of 980 MPa or higher grades, in general, precipitation strengthening using fine precipitates is employed. The inventors of the present disclosure performed additional studies and have newly found the following findings: in a hot-rolled steel sheet, when the amount of precipitates having a diameter of less than 20 nm exceeds a certain value, considerable degradation of the punching workability of the hot-rolled steel sheet occurs.

Incidentally, the term "punching workability" used herein denotes the following: a blank sheet having dimensions of about 50 mm×50 mm is sampled; in the blank sheet, a ϕ20 mm hole is punched with a ϕ20 mm punch under conditions of a clearance within 20%±2%; and the state of fracture of the punched-hole fracture surface (also referred to as a punched edge) is observed to evaluate the punching workability. The "punching workability" is evaluated as being good in the following case: a blank sheet having dimensions of about 50 mm×50 mm is sampled; in the blank sheet, a ϕ20 mm hole is punched with a ϕ20 mm punch under conditions of a clearance within 20%±2%; and the state of fracture of the punched-hole fracture surface (also referred to as a punched edge) is observed and no cracking, chipping, brittle fracture surface, or secondary shear surface is found.

The term "hole expandability" denotes the following: a hole expanding test piece (dimensions: t×100×100 mm) is sampled; in accordance with The Japan Iron and Steel Federation Standard JFST 1001, a hole is punched to form a punched hole with a ϕ10 mm punch and with a clearance of 12.5%; a 60° conical punch is inserted into the punched hole so as to push up the test piece in the punching direction; a diameter d mm of the hole is determined at the time of crack penetrating through the sheet thickness; and a hole expansion ratio, λ (%), defined by the following formula is used to evaluate the hole expandability.

$$\lambda\ (\%)=\{(d-10)/10\}\times 100$$

The "hole expandability" is evaluated as being good when the hole expansion ratio, λ (%), is 60% or more.

On the basis of these findings, the inventors of the present disclosure performed additional research and studied on the composition, the average aspect ratio of prior-austenite grains after completion of finish rolling, the area ratio of prior-austenite grains recrystallized after completion of finish rolling, the area ratio and grain diameter of a martensite phase or martensite-austenite constituent, and the amount of precipitates having a diameter of less than 20 nm precipitated in a hot-rolled steel sheet that are necessary for improving the punching workability and the hole expandability while still providing a high strength of a tensile strength TS of 980 MPa or more. As a result, the inventors have found that the following are important: the Si content is set to be 0.2% or more by mass %; the B content is set to be 0.0005% or more by mass %; prior-austenite grains after completion of finish rolling are set to have an average aspect ratio of 1.3 or more and 5.0 or less; prior-austenite grains recrystallized after completion of finish rolling are set to have an area ratio of 15% or less; a martensite phase or martensite-austenite constituent is set to have an area ratio of 15% or less; the martensite phase or martensite-austenite constituent is set to have an average grain diameter of 3.0 μm or less; and, in the hot-rolled steel sheet, the amount of precipitates having a diameter of less than 20 nm is set to be 0.10% or less by mass %.

The present disclosure has been completed on the basis of the findings and additional studies.

[1] A high-strength hot-rolled steel sheet having a composition containing, by mass %, C: 0.04% or more and 0.18% or less, Si: 0.2% or more and 2.0% or less, Mn: 1.0% or more and 3.0% or less, P: 0.03% or less, S: 0.005% or less, Al: 0.005% or more and 0.100% or less, N: 0.010% or less, Ti: 0.02% or more and 0.15% or less, Cr: 0.10% or more and 1.00% or less, B: 0.0005% or more and 0.0050% or less, the balance being Fe and inevitable impurities, and having a microstructure including a bainite phase having an area ratio of 85% or more as a main phase, and a martensite phase or martensite-austenite constituent having an area ratio of 15% or less as a second phase, the balance being a ferrite phase, wherein the second phase has an average grain diameter of 3.0 μm or less, prior-austenite grains have an average aspect ratio of 1.3 or more and 5.0 or less, recrystallized prior-austenite grains have an area ratio of 15% or less relative to non-recrystallized prior-austenite grains, and the hot-rolled steel sheet contains precipitates having a diameter of less than 20 nm in an amount of 0.10% or less by mass %, and has a tensile strength TS of 980 MPa or more.

[2] The high-strength hot-rolled steel sheet according to [1], wherein the composition further contains, by mass %, one or more selected from Nb: 0.005% or more and 0.050% or less, V: 0.05% or more and 0.30% or less, and Mo: 0.05% or more and 0.30% or less.

[3] The high-strength hot-rolled steel sheet according to [1] or [2], wherein the composition further contains, by mass %, one or two selected from Cu: 0.01% or more and 0.30% or less, and Ni: 0.01% or more and 0.30% or less.

[4] The high-strength hot-rolled steel sheet according to any one of [1] to [3], wherein the composition further contains, by mass %, one or more selected from Sb: 0.0002% or more and 0.020% or less, Ca: 0.0002% or more and 0.0050% or less, and REM: 0.0002% or more and 0.010% or less.

[5] A method for manufacturing the high-strength hot-rolled steel sheet according to any one of [1] to [4] above, the method including: heating a steel material at 1150° C. or more; subsequently subjecting the steel material to hot rolling in which a finish rolling start temperature is 1000° C. or more and 1200° C. or less, and a finishing delivery temperature is 830° C. or more and 950° C. or less; starting cooling within 2.0 s from completion of finish rolling in the hot rolling, and performing the cooling at an average cooling rate of 30° C./s or more to a cooling stop temperature of 300° C. or more and 530° C. or less; and performing coiling at the cooling stop temperature.

Herein, the term "main phase" means a phase having an area ratio of 85% or more. The term "precipitates having a diameter of less than 20 nm" means precipitates having sizes that can pass through a filter having an opening size of 20 nm described later.

Advantageous Effects

The present disclosure provides a high-strength hot-rolled steel sheet that has a tensile strength TS of 980 MPa or more, and is excellent in punching workability and hole expandability. In addition, such high-strength hot-rolled steel sheets can be manufactured with stability, which markedly exerts advantageous effects on industry.

Application of a high-strength hot-rolled steel sheet according to the present disclosure to automobile structural members, automobile skeleton members, frame parts of trucks, or the like also provides advantageous effects of enabling a reduction in the weight of automobile bodies while ensuring the safety of the automobiles, which enables a reduction in the environmental load.

As has been described, the present disclosure is highly advantageous for industry.

DESCRIPTION OF EXEMPLARY EMBODIMENTS

Hereinafter, the present disclosure will be described with regard to exemplary embodiments.

A high-strength hot-rolled steel sheet according to the present disclosure has a composition containing, by mass %, C: 0.04% or more and 0.18% or less, Si: 0.2% or more and 2.0% or less, Mn: 1.0% or more and 3.0% or less, P: 0.03% or less, S: 0.005% or less, Al: 0.005% or more and 0.100% or less, N: 0.010% or less, Ti: 0.02% or more and 0.15% or less, Cr: 0.10% or more and 1.00% or less, B: 0.0005% or more and 0.0050% or less, the balance being Fe and inevitable impurities, and has a microstructure including a bainite phase having an area ratio of 85% or more as a main phase, and a martensite phase or martensite-austenite constituent having an area ratio of 15% or less as a second phase, the balance being a ferrite phase, wherein the second phase has an average grain diameter of 3.0 μm or less, prior-austenite grains have an average aspect ratio of 1.3 or more and 5.0 or less, recrystallized prior-austenite grains have an area ratio of 15% or less relative to non-recrystallized prior-austenite grains, and the hot-rolled steel sheet contains precipitates having a diameter of less than 20 nm in an amount of 0.10% or less by mass %, and has, as strength, a tensile strength TS of 980 MPa or more.

The reasons for limiting the chemical composition of a high-strength hot-rolled steel sheet according to the present disclosure will be first described. Incidentally, % used for describing the chemical composition below means mass % unless otherwise specified.

C: 0.04% or More and 0.18% or Less

C is an element that improves the strength of a hot-rolled steel sheet, and that improves the hardenability to thereby promote generation of bainite. Thus, in the present disclosure, the C content needs to be set to 0.04% or more. On the other hand, when the C content is more than 0.18%, it becomes difficult to control generation of bainite, and the amount of a martensite phase or a martensite-austenite constituent generated increases, which results in degradation of one or both of the punching workability and hole expandability of the hot-rolled steel sheet. For this reason, the C content is set to be 0.04% or more and 0.18% or less. Preferably, the C content is 0.04% or more. Preferably, the C content is 0.16% or less. More preferably, the C content is 0.04% or more. More preferably, the C content is 0.14% or less. Still more preferably, it is 0.05% or more. Still more preferably, the C content is less than 0.12%.

Si: 0.2% or More and 2.0% or Less

Si is an element that contributes to solid-solution strengthening. Si is also an element that decreases the stacking fault energy to thereby increase the dislocation density of the bainite phase and to contribute to an increase in the strength of the hot-rolled steel sheet. In order to achieve these effects, the Si content needs to be set to 0.2% or more. Si is also an element that suppresses formation of carbide. Formation of carbide during bainite transformation is suppressed, to thereby cause formation of a fine martensite phase or martensite-austenite constituent in the lath interface of the bainite phase. The martensite phase or martensite-austenite constituent present in the bainite phase is sufficiently fine, so that it does not cause degradation of the hole expandability of the hot-rolled steel sheet. On the other hand, Si is an element that promotes generation of ferrite. When the Si content is more than 2.0%, ferrite is generated, which causes degradation of the hole expandability of the hot-rolled steel sheet. For this reason, the Si content is set to be 2.0% or less. Preferably, the Si content is 0.3% or more. Preferably, the Si content is 1.8% or less. More preferably, the Si content is 0.4% or more. More preferably, the Si content is 1.6% or less.

Mn: 1.0% or More and 3.0% or Less

Mn forms a solid solution to contribute to an increase in the strength of the hot-rolled steel sheet. In addition, Mn improves the hardenability to thereby promote generation of bainite to improve the hole expandability. In order to achieve these effects, the Mn content needs to be set to 1.0% or more. On the other hand, when the Mn content is more than 3.0%, it becomes difficult to control generation of bainite, and the amount of a martensite phase or a martensite-austenite constituent increases. This results in degradation of one or both of the punching workability and hole expandability of the hot-rolled steel sheet. For this reason, the Mn content is set to be 1.0% or more and 3.0% or less. Preferably, the Mn content is 1.3% or more. Preferably, the Mn content is 2.5% or less. More preferably, the Mn content is 1.5% or more. More preferably, the Mn content is 2.2% or less.

P: 0.03% or Less

P is an element that forms a solid solution to contribute to an increase in the strength of the hot-rolled steel sheet. However, P is also an element that segregates in grain boundaries, in particular, prior-austenite grain boundaries, to cause degradation of workability. For this reason, the P content is preferably minimized; however, a P content up to 0.03% is acceptable. Thus, the P content is set to be 0.03% or less. However, an excessive reduction in the P content does not provide advantages balanced with the increase in the refining costs. For this reason, preferably, the P content is 0.003% or more and 0.03% or less. More preferably, the P content is 0.005% or more. More preferably, the P content is 0.02% or less.

S: 0.005% or Less

S bonds with Ti or Mn to form coarse sulfide to cause degradation of the punching workability of the hot-rolled steel sheet. For this reason, the S content is preferably minimized; however, a S content of up to 0.005% is acceptable. For this reason, the S content is set to be 0.005% or less. From the viewpoint of punching workability, the S content is preferably 0.004% or less. However, an excessive reduction in the S content does not provide advantages balanced with the increase in the refining costs. For this reason, the S content is preferably 0.0003% or more.

Al: 0.005% or More and 0.100% or Less

Al is an element that functions as a deoxidizing agent and is effective to improve the cleanliness of steel. When the Al content is less than 0.005%, this effect is not necessarily sufficiently exerted. On the other hand, an excessive addition of Al causes an increase in the amount of oxide inclusions, which causes degradation of the punching workability of the hot-rolled steel sheet and also causes generation of imperfections. For this reason, the Al content is set to be 0.005% or more and 0.100% or less. Preferably, the Al content is 0.01% or more. Preferably, the Al content is 0.08% or less. More preferably, the Al content is 0.02% or more. More preferably, the Al content is 0.06% or less.

N: 0.010% or Less

N bonds to nitride-forming elements and, as a result, precipitates as nitrides to contribute to a decrease in the size of crystal grains. However, N tends to bond to Ti at high temperatures to form a coarse nitride, which causes degradation of the punching workability of the hot-rolled steel sheet. For this reason, the N content is set to be 0.010% or less. Preferably, the N content is 0.008% or less. More preferably, the N content is 0.006% or less.

Ti: 0.02% or More and 0.15% or Less

Ti forms nitride in an austenite-phase high-temperature range (a high-temperature range in the austenite-phase range and a range of high temperatures (in the casting stage) beyond the austenite-phase range). As a result, precipitation of BN is suppressed, and B forms a solid solution, to thereby achieve hardenability necessary for generation of bainite, which enables improvements in the strength and hole expandability of the hot-rolled steel sheet. Ti also exerts an effect of forming carbide during hot rolling to suppress recrystallization of prior-austenite grains, which enables finish rolling in the non-recrystallization temperature range. In order to exert these effects, the Ti content needs to be set to 0.02% or more. On the other hand, when the Ti content is more than 0.15%, the recrystallization temperature of prior-austenite grains becomes high, and austenite grains after completion of finish rolling have an aspect ratio of more than 5.0, which causes degradation of the punching workability. For this reason, the Ti content is set to be 0.02% or more and 0.15% or less. Preferably, the Ti content is 0.025% or more. Preferably, the Ti content is 0.13% or less. More preferably, the Ti content is 0.03% or more. More preferably, the Ti content is 0.12% or less.

Cr: 0.10% or More and 1.00% or Less

Cr is an element that forms carbide to contribute to an increase in the strength of the hot-rolled steel sheet, and that improves the hardenability to promote generation of bainite and to promote precipitation of an Fe-based carbide within bainite grains. In order to exert these effects, the Cr content is set to be 0.10% or more. On the other hand, when the Cr content is more than 1.00%, a martensite phase or a martensite-austenite constituent tends to be generated, which results in degradation of one or both of the punching workability and the hole expandability of the hot-rolled steel sheet. For this reason, the Cr content is set to be 0.10% or more and 1.00% or less. Preferably, the Cr content is 0.15% or more. More preferably, the Cr content is 0.20% or more. Preferably, the Cr content is 0.85% or less. More preferably, the Cr content is 0.75% or less. Still more preferably, the Cr content is 0.65% or less.

B: 0.0005% or More and 0.0050% or Less

B is an element that segregates in prior-austenite grain boundaries, to suppress generation and growth of ferrite, to contribute to improvements in the strength and the hole expandability of the hot-rolled steel sheet. In order to exert these effects, the B content is set to be 0.0005% or more. On the other hand, when the B content is more than 0.0050%, the above-described effects are saturated. For this reason, the B content is limited to 0.0005% or more and 0.0050% or less. Preferably, the B content is 0.0006% or more. Preferably, the B content is 0.0040% or less. More preferably, the B content is 0.0007% or more. More preferably, the B content is 0.0030% or less.

In the present disclosure, the balance of the above-described composition is Fe and inevitable impurities. Examples of the inevitable impurities include Sn and Zn. A Sn content of 0.1% or less and a Zn content of 0.01% or less are acceptable.

The basic components of a hot-rolled steel sheet according to the present disclosure have been described so far. However, for example, for the purpose of increasing the strength or improving the hole expandability, a hot-rolled steel sheet according to the present disclosure may optionally contain one or more selected from Nb: 0.005% or more and 0.050% or less, V: 0.05% or more and 0.30% or less, and Mo: 0.05% or more and 0.30% or less.

Nb: 0.005% or More and 0.050% or Less

Nb forms carbide during hot rolling to exert an effect of suppressing recrystallization of austenite, and contributes to an increase in the strength of the hot-rolled steel sheet. In order to exert this effect, the Nb content needs to be set to 0.005% or more. On the other hand, when the Nb content is more than 0.050%, the recrystallization temperature of prior-austenite grains becomes excessively high, and austenite grains after completion of finish rolling have an aspect ratio of more than 5.0, which may result in degradation of the punching workability. For this reason, when Nb is contained, the Nb content is set to be 0.005% or more and 0.050% or less. Preferably, the Nb content is 0.010% or more. Preferably, the Nb content is 0.045% or less. More preferably, the Nb content is 0.015% or more. More preferably, the Nb content is 0.040% or less.

V: 0.05% or More and 0.30% or Less

V forms carbonitride during hot rolling to exert an effect of suppressing recrystallization of austenite, and contributes to an increase in the strength of the hot-rolled steel sheet. In order to exert this effect, the V content needs to be set to 0.05% or more. On the other hand, when the V content is more than 0.30%, the recrystallization temperature of prior-austenite grains becomes excessively high, and austenite grains after completion of finish rolling have an aspect ratio of more than 5.0, which may result in degradation of the punching workability. For this reason, when V is contained, the V content is set to be 0.05% or more and 0.30% or less. Preferably, the V content is 0.07% or more. Preferably, the V content is 0.28% or less. More preferably, the V content is 0.10% or more. More preferably, the V content is 0.25% or less.

Mo: 0.05% or More and 0.30% or Less

Mo improves the hardenability to promote formation of a bainite phase, to contribute to improvements in the strength and hole expansion of the hot-rolled steel sheet. In order to exert such an effect, the Mo content is preferably set to be 0.05% or more. However, when the Mo content is more than 0.30%, a martensite phase or a martensite-austenite constituent tends to be generated, which may result in degradation of one or both of the punching workability and the hole expandability of the hot-rolled steel sheet. For this reason, when Mo is contained, the Mo content is set to be 0.05% or more and 0.30% or less. Preferably, the Mo content is 0.10% or more. Preferably, the Mo content is 0.25% or less.

A hot-rolled steel sheet according to the present disclosure may optionally contain one or two selected from Cu: 0.01% or more and 0.30% or less and Ni: 0.01% or more and 0.30% or less.

Cu: 0.01% or More and 0.30% or Less

Cu is an element that forms a solid solution to contribute to an increase in the strength of the hot-rolled steel sheet. Cu also improves the hardenability to promote formation of a bainite phase, to contribute to improvements in the strength and the hole expandability. In order to exert such effects, the Cu content is preferably set to be 0.01% or more. However, when the content is more than 0.30%, the surface quality of the hot-rolled steel sheet may be degraded. For this reason, when Cu is contained, the Cu content is set to be 0.01% or more and 0.30% or less. Preferably, the Cu content is 0.02% or more. Preferably, the Cu content is 0.20% or less.

Ni: 0.01% or More and 0.30% or Less

Ni is an element that forms a solid solution to contribute to an increase in the strength of the hot-rolled steel sheet. Ni also improves the hardenability to promote formation of a bainite phase, to contribute to improvements in the strength and the hole expandability. In order to exert such effects, the Ni content is preferably set to be 0.01% or more. However, when the Ni content is more than 0.30%, a martensite phase or a martensite-austenite constituent tends to be generated, and one or both of the punching workability and the hole expandability of the hot-rolled steel sheet may be degraded. For this reason, when Ni is contained, the Ni content is set to be 0.01% or more and 0.30% or less. Preferably, the Ni content is 0.02% or more. Preferably, the Ni content is 0.20% or less.

A hot-rolled steel sheet according to the present disclosure may optionally contain one or more selected from Sb: 0.0002% or more and 0.020% or less, Ca: 0.0002% or more and 0.0050% or less, and REM: 0.0002% or more and 0.010% or less.

Sb: 0.0002% or More and 0.020% or Less

Sb exerts an effect of suppressing nitride formation in the surface of a slab in the stage of heating the slab. This results in suppression of precipitation of BN in the surface layer portion of the slab. In addition, since solid solute B is present, hardenability necessary for generation of bainite can be obtained also in the surface layer portion of the hot-rolled steel sheet, which enables improvements in the strength and the hole expandability of the hot-rolled steel sheet. In order to exert such effects, the amount needs to be set to 0.0002% or more. On the other hand, when the Sb content is more than 0.020%, an increase in the rolling force is caused, which may result in degradation of the productivity. For this reason, when Sb is contained, the Sb content is set to be 0.0002% or more and 0.020% or less.

Ca: 0.0002% or More and 0.0050% or Less

Ca is effective to control the shape of sulfide inclusions to improve the punching workability of the hot-rolled steel sheet. In order to exert these effects, the Ca content is preferably set to be 0.0002% or more. However, when the Ca content is more than 0.0050%, surface defects of the hot-rolled steel sheet may be caused. For this reason, when Ca is contained, the Ca content is set to be 0.0002% or more and 0.0050% or less. Preferably, the Ca content is 0.0004% or more. Preferably, the Ca content is 0.0030% or less.

REM: 0.0002% or More and 0.010% or Less

As with Ca, REM controls the shape of sulfide inclusions to reduce the adverse effects of sulfide inclusions on the punching workability of the hot-rolled steel sheet. In order to exert these effects, the REM content is preferably set to be 0.0002% or more. However, when the REM content becomes excessive beyond 0.010%, the cleanliness of steel tends to degrade, and the punching workability of the hot-rolled steel sheet tends to degrade. For this reason, when REM is contained, the REM content is set to be 0.0002% or more and 0.010% or less. Preferably, the REM content is 0.0004% or more. Preferably, the REM content is 0.0050% or less.

Hereinafter, the reasons for limiting the microstructure of a high-strength hot-rolled steel sheet according to the present disclosure will be described.

In a high-strength hot-rolled steel sheet according to the present disclosure, prior-austenite grains after completion of finish rolling have an average aspect ratio of 1.3 or more and 5.0 or less, and recrystallized prior-austenite grains have an area ratio of 15% or less relative to non-recrystallized prior-austenite grains. The steel sheet has a microstructure including a bainite phase having an area ratio of 85% or more as a main phase, and a martensite or martensite-austenite constituent having an area ratio of 15% or less as a second phase, the second phase having an average grain diameter of 3.0 μm or less, the balance being a ferrite phase. The hot-rolled steel sheet contains precipitates having a diameter of less than 20 nm precipitated in an amount of 0.10% or less by mass %, and has a tensile strength TS of 980 MPa or more. The high-strength hot-rolled steel sheet is excellent in punching workability and hole expandability. The second phase may have an area ratio of 0%; the ferrite phase may also have an area ratio of 0%.

Average Aspect Ratio of Prior-Austenite Grains: 1.3 or More and 5.0 or Less

Prior-austenite grains are austenite grains that are formed during heating of the steel material. The grain boundaries of prior-austenite grains formed at the time of completion of finish rolling remain without disappearing even after subsequent cooling and coiling processes.

A high-strength hot-rolled steel sheet according to the present disclosure is provided such that, at the time of completion of finish rolling, prior-austenite grains have an average aspect ratio of 1.3 or more and 5.0 or less. In order to obtain a bainite phase having a high strength of a tensile strength TS of 980 MPa or more, and being excellent in hole expandability, sufficient strain needs to be introduced into prior-austenite grains to be transformed into bainite. In order to achieve this, prior-austenite grains need to be provided so as to have an average aspect ratio of 1.3 or more. On the other hand, when prior-austenite grains have an excessively high average aspect ratio of more than 5.0, separation occurs in a punched edge after punching, and degradation of the punching workability occurs. For this reason, prior-austenite grains are provided so as to have an average aspect ratio of 1.3 or more and 5.0 or less. More preferably, prior-austenite grains have an average aspect ratio of 1.4 or more. More preferably, prior-austenite grains have an average aspect ratio of 4.0 or less. Still more preferably, prior-austenite grains have an average aspect ratio of 1.5 or more. Still more preferably, prior-austenite grains have an average aspect ratio of 3.5 or less.

Incidentally, the average aspect ratio of prior-austenite grains can be controlled to be 1.3 or more and 5.0 or less by adjusting the C, Ti, Nb, or V content, adjusting the finish rolling start temperature, adjusting the finishing delivery temperature, or adjusting cooling between finish rolling stands.

Ratio of Recrystallized Prior-Austenite Grains to Non-Recrystallized Prior-Austenite Grains: Area Ratio of 15% or Less Among the prior-austenite grains, grains having recrystallized from the time of completion of finish rolling to completion of coiling are referred to as recrystallized prior-austenite grains, while grains not having recrystallized are referred to as non-recrystallized prior-austenite grains.

A high-strength hot-rolled steel sheet according to the present disclosure is provided such that prior-austenite grains recrystallized after completion of finish rolling have an area ratio of 15% or less. In the case of recrystallization of prior-austenite grains after completion of finish rolling, diffusion of B to and segregation of B in prior-austenite grain boundaries cannot be achieved, so that desired hardenability cannot be exerted, which results in a decrease in the strength. In addition, a difference in hardness is generated between non-recrystallized prior-austenite grains and recrystallized prior-austenite grains, which also results in degradation of the hole expandability. In order to obtain a hot-rolled steel sheet that has a desired strength, the area ratio of recrystallized prior-austenite grains is preferably set to be 0%. However, recrystallized prior-austenite grains having an area ratio of 15% or less are acceptable. Thus, recrystallized prior-austenite is set to have an area ratio of 15% or less. Preferably, recrystallized prior-austenite has an area ratio of 13% or less, more preferably 10% or less, still more preferably 5% or less.

Incidentally, the area ratio of recrystallized prior-austenite grains can be controlled to be 15% or less by adjusting the C, Ti, Nb, or V content, adjusting the finish rolling start temperature, adjusting the finishing delivery temperature, or adjusting cooling between finish rolling stands.

Microstructure of Steel Sheet

Bainite phase (main phase): area ratio of 85% or more

Martensite or martensite-austenite constituent (second phase): area ratio of 15% or less, and average grain diameter of 3.0 μm or less Balance: ferrite phase A high-strength hot-rolled steel sheet according to the present disclosure includes a bainite phase as a main phase. The term "bainite phase" means a microstructure including lath-like bainitic ferrite and Fe-based carbide between and/or inside bainitic ferrite (cases of no precipitation of Fe-based carbide at all are included). Unlike polygonal ferrite, bainitic ferrite, which has a lath-like shape and has a relatively high dislocation density in the inside, can be easily distinguished with a SEM (scanning electron microscope) or a TEM (transmission electron microscope). In order to achieve a tensile strength TS of 980 MPa or more and to improve the hole expandability, a bainite phase needs to be formed as a main phase. When the bainite phase has an area ratio of 85% or more, a tensile strength TS of 980 MPa or more and excellent hole expandability can be both achieved. For this reason, the area ratio of the bainite phase is set to be 85% or more. The bainite phase preferably has an area ratio of 90% or more, more preferably 95% or more. When the second phase structure is provided such that a martensite phase or a martensite-austenite constituent has an area ratio of 15% or less and the structure has an average grain diameter of 3.0 μm or less, macroscopic stress concentration does not occur in phase interfaces in a hole expanding test, and excellent hole expandability is achieved. For this reason, the area ratio of the martensite or martensite-austenite constituent is set to be 15% or less, and the average grain diameter of the structure is set to be 3.0 μm or less. The martensite or martensite-austenite constituent preferably has an area ratio of 10% or less, and the structure preferably has an average grain diameter of 2.0 μm or less. Still more preferably, the martensite or martensite-austenite constituent has an area ratio of 3% or less, and the structure has an average grain diameter of 1.0 μm or less. In addition to the bainite phase as a main phase and the martensite phase or martensite-austenite constituent as a second phase, a ferrite phase may be included as another structure.

Precipitates Having Diameter of Less than 20 nm: 0.10% or Less by Mass %

A high-strength hot-rolled steel sheet according to the present disclosure is provided such that the amount of precipitates having a diameter of less than 20 nm is 0.10% or less by mass %. In order to achieve desired excellent punching workability of a hot-rolled steel sheet, the amount of precipitates having a diameter of less than 20 nm is desirably set to 0% by mass %; however, amounts of up to 0.10% are acceptable. When the amount of precipitates having a diameter of less than 20 nm is more than 0.10% by mass %, brittle cracking occurs during punching, and considerable degradation of the punching workability occurs. For this reason, the amount of precipitates having a diameter of less than 20 nm is set to be 0.10% or less by mass %. Preferably, the amount of precipitates having a diameter of less than 20 nm is 0.08% or less by mass %, more preferably 0.07% or less.

Incidentally, precipitates having a diameter of less than 20 nm can be controlled by adjusting the Ti, Nb, Mo, V, or Cu content, adjusting the finishing delivery temperature, or adjusting the coiling temperature.

In addition, the aspect ratio of prior-austenite grains after completion of finish rolling, the area ratio of prior-austenite grains recrystallized after completion of finish rolling, the area ratios of a bainite phase, a martensite phase or a martensite-austenite constituent, and a ferrite phase, the mass of precipitates having a diameter of less than 20 nm, can be measured by methods in EXAMPLES described later.

Hereinafter, a method for manufacturing a high-strength hot-rolled steel sheet according to the present disclosure will be described.

The present disclosure provides a method for manufacturing a high-strength hot-rolled steel sheet, the method including heating a steel material having the above-described composition at 1150° C. or more, subsequently subjecting the steel material to hot rolling in which rough rolling is performed, a finish rolling start temperature is 1000° C. or more and 1200° C. or less, and a finishing delivery temperature is 830° C. or more and 950° C. or less, to cooling started within 2.0 s from completion of finish rolling of the hot rolling and performed at an average cooling rate of 30° C./s or more to a cooling stop temperature of 300° C. or more and 530° C. or less, and to coiling at a coiling temperature that is the cooling stop temperature.

Hereafter, detailed descriptions will be provided.

The method for manufacturing the steel material is not particularly limited, and any ordinary method can be employed in which molten steel having the above-described composition is prepared with a converter or the like, and subjected to a casting process such as continuous casting to provide a steel material such as a slab. Incidentally, an ingot making-slabbing method may be employed.

Heating Temperature for Steel Material: 1150° C. or More

In the steel material such as a slab, most of carbonitride-forming elements such as Ti are present as coarse carbonitrides. The presence of such coarse and nonuniform precipitates causes degradation of various properties of the hot-rolled steel sheet (for example, strength or punching workability). For this reason, the steel material before hot rolling is heated to cause such coarse precipitates to form solid solutions. In order to cause such coarse precipitates to sufficiently form solid solutions before hot rolling, the heating temperature for the steel material needs to be set at 1150° C. or more. When the heating temperature for the steel material is excessively high, imperfections of the slab may occur or a decrease in the yield due to descaling may occur. For this reason, the heating temperature for the steel material is preferably set to be 1350° C. or less. More preferably, the heating temperature for the steel material is 1180° C. or more. More preferably, the heating temperature for the steel material is 1300° C. or less. Still more preferably, the heating temperature for the steel material is 1200° C. or more. Still more preferably, the heating temperature for the steel material is 1280° C. or less.

The steel material is thus held for a predetermined time under heating at a heating temperature of 1150° C. or more. However, when the holding time is more than 9000 seconds, the amount of scale generated increases, and, as a result, rolled-in scale or the like tends to occur in the subsequent hot-rolling process, which tends to result in degradation of the surface quality of the hot-rolled steel sheet. For this reason, the holding time for the steel material in the temperature range of 1150° C. or more is preferably set to 9000 seconds or less. More preferably, the holding time for the steel material in the temperature range of 1150° C. or more is 7200 seconds or less. The lower limit of the holding time for the steel material in the temperature range of 1150° C. or more is not particularly specified; however, the holding time is preferably 1800 seconds or more from the viewpoint of uniformity of heating of the slab.

Subsequent to the heating of the steel material, hot rolling including rough rolling and finish rolling is performed. Conditions for the rough rolling need not be particularly limited as long as desired sheet bar dimensions are ensured. Subsequent to the rough rolling, finish rolling is performed. Incidentally, before the finish rolling or during rolling between stands, descaling is preferably performed. As necessary, the steel sheet may be cooled between stands. A finish rolling start temperature is set to be 1000° C. or more and 1200° C. or less, while a finishing delivery temperature is set to be 830° C. or more and 950° C. or less.

Finish Rolling Start Temperature: 1000° C. or More and 1200° C. or Less

When the finish rolling start temperature is more than 1200° C., the amount of scale generated increases and rolled-in scale or the like tends to occur, which tends to result in degradation of the surface quality of the hot-rolled steel sheet. When the finish rolling start temperature is less than 1000° C., prior-austenite grains cannot recrystallize during finish rolling, so that prior-austenite grains after completion of finish rolling may have an average aspect ratio of more than 5.0, which may result in degradation of the punching workability. For this reason, the finish rolling start temperature is set to be 1000° C. or more and 1200° C. or less. Preferably, the finish rolling start temperature is 1020° C. or more. Preferably, the finish rolling start temperature is 1160° C. More preferably, the finish rolling start temperature is 1050° C. or more. More preferably, the finish rolling start temperature is 1140° C. or less. The finish rolling start temperature used herein denotes the surface temperature of the sheet.

Finishing Delivery Temperature: 830° C. or More and 950° C. or Less

When the finishing delivery temperature is less than 830° C., the rolling is performed in the ferrite-austenite dual-phase temperature range, so that a desired fraction of a bainite phase cannot be achieved, which results in degradation of the hole expandability of the hot-rolled steel sheet. In addition, since a rolling reduction to prior-austenite grains in the non-recrystallized temperature range increases, prior-austenite grains after completion of finish rolling may have an average aspect ratio of more than 5.0, which may result in degradation of the punching workability. On the other hand, when the finishing delivery temperature becomes higher beyond 950° C., the number of prior-austenite grains recrystallized after completion of finish rolling increases, and B cannot segregate in prior-austenite grain boundaries, so that a tensile strength TS of 980 MPa or more cannot be achieved, or degradation of the hole expandability occurs. For this reason, the finishing delivery temperature is set to be 830° C. or more and 950° C. or less. Preferably, the finishing delivery temperature is 850° C. or more. Preferably, the finishing delivery temperature is 940° C. or less. More preferably, the finishing delivery temperature is 870° C. or more. More preferably, the finishing delivery temperature is 930° C. or less. The finishing delivery temperature used herein denotes the surface temperature of the sheet.

Start of Forced Cooling: Start Cooling within 2.0 s from Completion of Finish Rolling After completion of the finish rolling, within 2.0 s, forced cooling is started. The cooling is stopped at a coiling temperature (cooling stop temperature), and coiling is performed. When the time from completion of the finish rolling to start of the forced cooling is longer than 2.0 s, recovery of strain accumulated in austenite proceeds, which results in a decrease in the strength of the bainite phase. As a result, a tensile strength TS of 980 MPa or more cannot be obtained. For this reason, the time of start of forced cooling is limited to a time within 2.0 s after completion of finish rolling. Preferably, the time of start of forced cooling is within 1.5 s after completion of finish rolling. More preferably, the time of start of forced cooling is within 1.0 s from completion of finish rolling.

Average Cooling Rate: 30° C./s or More

When the forced cooling is performed from the finishing delivery temperature to the coiling temperature at an average cooling rate of less than 30° C./s, ferrite transformation occurs before bainite transformation, so that a desired area ratio of the bainite phase cannot be achieved. For this reason, the average cooling rate is set to be 30° C./s or more. Preferably, the average cooling rate is 35° C./s or more. The upper limit of the average cooling rate is not particularly specified. However, when the average cooling rate is excessively high, the surface temperature becomes excessively low, so that martensite tends to be generated in the steel sheet surface, and a desired hole expandability may not be achieved. For this reason, the average cooling rate is preferably set to be 120° C./s or less. Incidentally, the average cooling rate denotes an average cooling rate at the surface of the steel sheet.

Coiling Temperature (Cooling Stop Temperature): 300° C. or More and 530° C. or Less The lower the coiling temperature (cooling stop temperature), the further bainite transformation is promoted, and the higher the area ratio of the bainite phase becomes. However, when the coiling temperature is less than 300° C., martensite transformation occurs to form a coarse martensite phase, so that a desired hole expandability cannot be achieved. On the other hand, when the coiling temperature is more than 530° C., the driving force for bainite transformation is insufficient, and bainite transformation does not complete. As a result, since the state of the presence of bainite and untransformed austenite is isothermally held, carbon is distributed to untransformed austenite. Thus, a coarse martensite phase or martensite-austenite constituent is generated, which results in degradation of the hole expandability. When the coiling temperature is more than 530° C., a carbide-forming element such as Ti, Nb, or V bonds to carbon to form precipitates having a diameter of less than 20 nm, which results in degradation of the punching workability. For this reason, the coiling temperature is set to be 300° C. or more and 530° C. or less. Preferably, the coiling temperature is 330° C. or more. Preferably, the coiling temperature is 510° C. or less. More preferably, the coiling temperature is 350° C. or more. Preferably, the coiling temperature is 480° C. or less.

Incidentally, in the present disclosure, in order to reduce segregation of steel components during continuous casting, electromagnetic stirring (EMS), intentional bulging soft reduction (IBSR), or the like can be employed. By performing an electromagnetic stirring treatment, equiaxed grains are formed in the sheet-thickness central portion, to thereby reduce segregation. When intentional bulging soft reduction is performed, molten steel in an unsolidified portion of the continuous casting slab is prevented from flowing, to thereby reduce segregation in the sheet-thickness central portion. At least one of these segregation reduction treatments is performed, to thereby further improve the punching workability and hole expandability described later.

After the coiling, as in the standard manner, temper rolling may be performed, or pickling may be performed to remove scales formed on the surface. Furthermore, a coating treatment such as hot-dip galvanization or electrogalvanization, or a chemical conversion treatment may also be performed.

EXAMPLES

Molten steels having compositions shown in Table 1 were prepared with a converter, and slabs (steel materials) were manufactured by a continuous casting method. During the continuous casting, in order to perform a treatment to reduce segregation, electromagnetic stirring (EMS) was performed except for hot-rolled steel sheet Nos. 22 and 23 (Steel K) in Tables 2 and 3 described later. Subsequently, these steel materials were heated under conditions shown in Table 2, and subjected to hot rolling constituted by rough rolling, and finish rolling performed under conditions shown in Table 2. After completion of the finish rolling, cooling was performed under conditions shown in Table 2: a cooling start time (time from completion of the finish rolling to start of cooling (forced cooling)) and an average cooling rate (average cooling rate from the finishing delivery temperature to the coiling temperature). Coiling is performed under conditions of coiling temperatures shown in Table 2, to provide hot-rolled steel sheets having sheet thicknesses shown in Table 2. Incidentally, in the finish rolling, cooling between stands was performed for Examples marked with 0.

From the resultant hot-rolled steel sheets, test pieces were sampled and subjected to observation of the microstructure, quantification of precipitates, a tensile test, a hole expanding test, and a punching test. The method of performing observation of the microstructure and the methods of performing the tests are as follows.

(i) Observation of Microstructure

Area Ratio and Grain Diameter of Each Microstructure

A test piece for a scanning electron microscope (SEM) was sampled from a hot-rolled steel sheet. A sheet thickness cross-section parallel to the rolling direction was polished. Subsequently, an etchant (3 mass % Nital solution) was used to reveal the microstructure. At a ¼ position of the sheet thickness, five fields of view were captured with a scanning electron microscope (SEM) at a magnification of 3000×, and subjected to image processing to quantify the area ratio and grain diameter of each phase (a bainite phase, a MA phase (martensite phase or martensite-austenite constituent), and a F phase (ferrite phase)).

Aspect Ratio of Prior-Austenite Grains (Prior-γ Grains) and Area Ratio of Recrystallized Grains after Finish Rolling From a hot-rolled steel sheet, a test piece for an optical microscope was sampled, and a sheet thickness cross-section parallel to the rolling direction was polished. Subsequently, an etchant (aqueous solution containing picric acid, a surfactant, and oxalic acid) was used to reveal a prior-austenite structure. At a ¼ position of the sheet thickness, five fields of view were captured with an optical microscope at a magnification of 400×. Prior-austenite grains were approximated to ellipses. Specifically, the longest portion of such a grain was measured as the major axis and the shortest portion was measured as the minor axis, and (major axis)/(minor axis) was determined as an aspect ratio. The arithmetic mean of such obtained aspect ratios of prior-austenite grains was determined as an average aspect ratio.

Among the prior-austenite grains, prior-austenite grains having an aspect ratio of 1.00 or more and 1.05 or less were defined as recrystallized prior-austenite grains, while prior-austenite grains having an aspect ratio of more than 1.05 were defined as non-recrystallized prior-austenite grains. Image processing was performed to determine the area of the recrystallized prior-austenite grains and the area of the non-recrystallized prior-austenite grains. The area ratio of the recrystallized prior-austenite grains to the non-recrystallized prior-austenite grains was determined.

When prior-austenite grains were difficult to be identified with an optical microscope, an electron-beam reflection diffraction (Electron Back Scatter Diffraction Patterns: EBSD) method using a SEM was performed to determine the area ratio of the recrystallized prior-austenite grains to the non-recrystallized prior-austenite grains. From a hot-rolled steel sheet, a test piece was sampled; and a cross-section parallel to the rolling direction was selected as an observation section and subjected to finish polishing with a colloidal silica solution. Subsequently, an EBSD measurement apparatus was used to perform measurements at an acceleration voltage of an electron beam of 20 kV, in an area of 500 μm×500 μm in measurement steps of 0.2 μm, for three sites at a ¼ position of the sheet thickness; and a rotation matrix method was used to reconstruct prior-austenite grains. The reconstructed prior-austenite grains were approximated to ellipses and measured for the aspect ratios.

The prior-austenite grains having an aspect ratio of 1.00 or more and 1.05 or less were defined as recrystallized prior-austenite grains, while the prior-austenite grains having an aspect ratio of more than 1.05 were defined as non-recrystallized prior-austenite grains. The area of the recrystallized prior-austenite grains and the area of the non-recrystallized prior-austenite grains were determined, and the area ratio of the recrystallized prior-austenite grains to the non-recrystallized prior-austenite grains was determined.

(ii) Quantification of Precipitates

From a hot-rolled steel sheet, a test piece (dimensions: 50 mm×50 mm) for extraction of electrolytic residue was sampled. In a 10% AA-based electrolyte (10 vol % acetylacetone-1 mass % tetramethylammonium chloride-methanol), the test piece was subjected to, for its whole thickness, constant-current electrolysis at a current density of 20 $mA/cm^2$. The resultant electrolyte was filtered through a filter having an opening size of 20 nm to achieve separation between precipitates having a diameter of 20 nm or more and precipitates having a diameter of less than 20 nm. The weight of the precipitates having a diameter of less than 20 nm was measured and divided by an electrolysis weight to determine mass % of precipitates having a diameter of less than 20 nm. Incidentally, the electrolysis weight was determined in the following manner: the electrolysis test piece after electrolysis was washed and measured for its weight; this weight was subtracted from the weight of the test piece before electrolysis to determine the electrolysis weight.

(iii) Tensile Test

From a hot-rolled steel sheet, a JIS No. 5 test piece (GL: 50 mm) was sampled such that its tensile direction was orthogonal to the rolling direction. A tensile test was performed in accordance with JIS Z 2241(2011) to determine yield strength (yield point, YP), tensile strength (TS), and total elongation (El).

(iv) Hole Expanding Test

From a hot-rolled steel sheet obtained, a test piece (dimensions: t×100 mm×100 mm) for a hole expanding test was sampled. In accordance with The Japan Iron and Steel Federation Standard JFST 1001, a punched hole is formed at the center of the test piece with a ϕ10 mm punch with a clearance of 12.5%; into the punched hole, a 60° conical punch was inserted in the punching direction so as to push up the test piece; a diameter d (mm) of the hole at the time of crack penetrating through the sheet thickness was determined and a hole expansion ratio, 2(%), defined by the following formula was calculated.

$$\lambda\ (\%)=\{(d-10)/10\}\times 100$$

Incidentally, the clearance is a ratio (%) relative to the sheet thickness. When λ determined in the hole expanding test is 60% or more, the hole expandability was evaluated as being good.

(v) Punching Test

From a hot-rolled steel sheet, 10 blank sheets (50 mm×50 mm) were sampled. As a punch, a ϕ20 mm flat-bottomed punch was employed. The die-side hole diameter was determined such that the punching clearance was within 20%±2%. While such a sheet was fixed from above with a sheet holder, a ϕ20 mm punched hole was formed. After the punching was performed for all the 10 blank sheets, the state of fracture of the punched edges of the punched holes was observed for their whole peripheries with a microscope (magnification: 50×), as to whether or not cracking, chipping, brittle fracture, a secondary shear surface, or the like was present. The 10 punched holes were evaluated for punching workability in the following manner: sheets in which 10 punched holes did not have cracking, chipping, brittle fracture, a secondary shear surface, or the like were evaluated as ⊙ (pass); sheets in which 8 to 9 punched holes did not have cracking, chipping, brittle fracture, a secondary shear surface, or the like were evaluated as ○ (pass); and the other sheets (0 to 7 punched holes did not have cracking, chipping, brittle fracture, a secondary shear surface, or the like) were evaluated as x (fail).

TABLE 1

| | Chemical Composition (mass %) Balance: Fe and Inevitable Impurities | | | | | | | | | | | |
|---|---|---|---|---|---|---|---|---|---|---|---|---|
| Steel | C | Si | Mn | P | S | Al | N | Ti | Cr | B | Others | Note |
| A | 0.075 | 0.88 | 1.75 | 0.013 | 0.0007 | 0.052 | 0.0029 | 0.081 | 0.30 | 0.0024 | — | Example Steel |
| B | 0.048 | 1.42 | 1.88 | 0.018 | 0.0011 | 0.054 | 0.0036 | 0.078 | 0.25 | 0.0018 | — | Example Steel |
| C | 0.118 | 1.45 | 1.82 | 0.009 | 0.0011 | 0.059 | 0.0048 | 0.038 | 0.33 | 0.0025 | — | Example Steel |
| D | 0.071 | 1.42 | 1.60 | 0.017 | 0.0014 | 0.028 | 0.0055 | 0.102 | 0.45 | 0.0022 | — | Example Steel |
| E | 0.101 | 1.54 | 2.23 | 0.017 | 0.0026 | 0.056 | 0.0025 | 0.043 | 0.35 | 0.0045 | — | Example Steel |
| F | 0.093 | 0.74 | 1.85 | 0.016 | 0.0008 | 0.045 | 0.0038 | 0.082 | 0.22 | 0.0017 | — | Example Steel |
| G | 0.165 | 1.21 | 1.96 | 0.024 | 0.0029 | 0.056 | 0.0045 | 0.065 | 0.36 | 0.0026 | — | Example Steel |
| H | 0.095 | 1.05 | 2.88 | 0.005 | 0.0013 | 0.043 | 0.0045 | 0.038 | 0.15 | 0.0017 | — | Example Steel |
| I | 0.086 | 0.25 | 2.15 | 0.011 | 0.0015 | 0.041 | 0.0030 | 0.091 | 0.25 | 0.0032 | — | Example Steel |
| J | 0.122 | 0.75 | 1.78 | 0.026 | 0.0008 | 0.030 | 0.0040 | 0.075 | 0.33 | 0.0023 | — | Example Steel |
| K | 0.072 | 0.68 | 1.08 | 0.011 | 0.0028 | 0.028 | 0.0028 | 0.141 | 0.36 | 0.0011 | — | Example Steel |
| L | 0.083 | 1.47 | 1.79 | 0.019 | 0.0022 | 0.033 | 0.0050 | 0.041 | 0.24 | 0.0015 | — | Example Steel |
| M | 0.102 | 1.92 | 2.07 | 0.008 | 0.0023 | 0.030 | 0.0046 | 0.075 | 0.37 | 0.0017 | Nb: 0.022 | Example Steel |
| N | 0.079 | 1.57 | 1.51 | 0.026 | 0.0006 | 0.019 | 0.0054 | 0.028 | 0.16 | 0.0015 | Nb: 0.041 | Example Steel |
| O | 0.078 | 0.77 | 2.37 | 0.029 | 0.0018 | 0.049 | 0.0064 | 0.129 | 0.20 | 0.0020 | V: 0.21 | Example Steel |
| P | 0.129 | 0.65 | 1.52 | 0.018 | 0.0007 | 0.060 | 0.0061 | 0.037 | 0.15 | 0.0015 | Mo: 0.15 | Example Steel |
| Q | 0.084 | 1.44 | 1.87 | 0.008 | 0.0011 | 0.058 | 0.0042 | 0.108 | 0.24 | 0.0028 | Cu: 0.22, Ni: 0.12 | Example Steel |
| R | 0.127 | 1.82 | 2.10 | 0.029 | 0.0034 | 0.035 | 0.0041 | 0.105 | 0.16 | 0.0026 | Sb: 0.012 | Example Steel |
| S | 0.096 | 0.95 | 2.24 | 0.024 | 0.0010 | 0.075 | 0.0038 | 0.054 | 0.14 | 0.0017 | Ca: 0.002, REM: 0.003 | Example Steel |
| T | 0.115 | 1.41 | 0.75 | 0.017 | 0.0014 | 0.021 | 0.0033 | 0.087 | 0.41 | 0.0013 | — | Comparative Steel |
| U | 0.205 | 0.99 | 1.87 | 0.005 | 0.0015 | 0.033 | 0.0041 | 0.051 | 0.13 | 0.0005 | — | Comparative Steel |
| V | 0.088 | 0.05 | 2.23 | 0.026 | 0.0013 | 0.045 | 0.0025 | 0.079 | 0.42 | 0.0025 | — | Comparative Steel |
| W | 0.126 | 1.27 | 2.20 | 0.022 | 0.0008 | 0.047 | 0.0040 | 0.056 | 0.34 | 0.0001 | — | Comparative Steel |
| X | 0.091 | 1.79 | 1.70 | 0.027 | 0.0004 | 0.035 | 0.0056 | 0.012 | 0.33 | 0.0013 | — | Comparative Steel |
| Y | 0.070 | 1.82 | 1.75 | 0.020 | 0.0005 | 0.029 | 0.0044 | 0.170 | 0.20 | 0.0025 | — | Comparative Steel |
| Z | 0.078 | 0.31 | 2.20 | 0.021 | 0.0016 | 0.043 | 0.0031 | 0.042 | 0.92 | 0.0016 | — | Example Steel |
| AA | 0.062 | 0.75 | 1.76 | 0.015 | 0.0008 | 0.037 | 0.0040 | 0.103 | 0.58 | 0.0019 | — | Example Steel |
| AB | 0.095 | 1.14 | 1.98 | 0.018 | 0.0006 | 0.051 | 0.0051 | 0.065 | 0.75 | 0.0021 | — | Example Steel |

TABLE 2

| Hot-Rolled Steel Sheet No. | Steel | Slab Heating Temperature (° C.) | Finish Rolling: Start Temperature (° C.) | Finish Rolling: Cooling between Stands | Finish Rolling: Delivery Temperature (° C.) | Cooling Start Time (s) (*1) | Average Cooling Rate (° C./s) (*2) | Coiling Temperature (° C.) | Sheet Thickness (mm) | Note |
|---|---|---|---|---|---|---|---|---|---|---|
| 1 | A | 1220 | 1110 | — | 900 | 0.5 | 50 | 450 | 2.9 | Example |
| 2 | A | 1230 | 1140 | ○ | 910 | 1.5 | 50 | 400 | 2.9 | Example |
| 3 | A | 1210 | 1110 | ○ | 890 | 0.0 | 40 | 520 | 3.2 | Example |
| 4 | A | 1200 | 1100 | — | 900 | 3.0 | 40 | 450 | 3.2 | Comparative Example |
| 5 | A | 1200 | 1030 | — | 810 | 0.5 | 50 | 460 | 2.6 | Comparative Example |
| 6 | A | 1220 | 1090 | — | 965 | 0.5 | 35 | 440 | 4.0 | Comparative Example |
| 7 | A | 1220 | 1070 | — | 895 | 1.0 | 20 | 460 | 4.0 | Comparative Example |
| 8 | B | 1180 | 1080 | — | 910 | 0.5 | 50 | 470 | 2.9 | Example |
| 9 | B | 1220 | 1120 | ○ | 895 | 1.0 | 35 | 420 | 4.0 | Example |
| 10 | C | 1220 | 1060 | ○ | 850 | 1.0 | 50 | 350 | 2.6 | Example |
| 11 | C | 1220 | 1060 | — | 890 | 1.0 | 50 | 275 | 2.9 | Comparative Example |
| 12 | D | 1190 | 1090 | — | 910 | 1.5 | 50 | 350 | 2.9 | Example |
| 13 | D | 1190 | 980 | — | 860 | 0.5 | 45 | 450 | 3.2 | Comparative Example |
| 14 | E | 1210 | 1090 | ○ | 870 | 1.0 | 60 | 400 | 2.6 | Example |
| 15 | F | 1230 | 1090 | — | 910 | 1.5 | 50 | 410 | 2.9 | Example |
| 16 | F | 1220 | 1110 | ○ | 885 | 0.0 | 45 | 470 | 3.2 | Example |
| 17 | G | 1170 | 1010 | — | 830 | 1.0 | 50 | 370 | 2.9 | Example |
| 18 | H | 1230 | 1130 | ○ | 900 | 1.5 | 50 | 330 | 2.9 | Example |
| 19 | I | 1200 | 1120 | — | 940 | 1.0 | 50 | 420 | 2.9 | Example |
| 20 | J | 1230 | 1080 | — | 900 | 0.5 | 50 | 400 | 2.6 | Example |
| 21 | J | 1210 | 1040 | — | 860 | 0.0 | 50 | 340 | 2.3 | Example |
| 22 | K | 1250 | 1170 | ○ | 930 | 1.5 | 60 | 400 | 2.6 | Example |
| 23 | K | 1260 | 1180 | ○ | 940 | 1.0 | 60 | 550 | 2.6 | Comparative Example |
| 24 | L | 1190 | 1040 | — | 860 | 1.5 | 50 | 460 | 2.9 | Example |
| 25 | L | 1220 | 1100 | ○ | 875 | 1.0 | 60 | 420 | 2.6 | Example |
| 26 | M | 1250 | 1090 | — | 910 | 1.0 | 50 | 370 | 2.9 | Example |
| 27 | N | 1250 | 1090 | — | 905 | 1.5 | 60 | 450 | 2.6 | Example |
| 28 | O | 1220 | 1080 | — | 900 | 0.5 | 50 | 450 | 2.9 | Example |
| 29 | P | 1200 | 1100 | ○ | 870 | 1.0 | 50 | 430 | 2.9 | Example |
| 30 | Q | 1240 | 1070 | ○ | 890 | 0.5 | 50 | 425 | 2.9 | Example |
| 31 | R | 1220 | 1100 | — | 920 | 1.0 | 50 | 435 | 2.9 | Example |
| 32 | S | 1200 | 1120 | ○ | 890 | 0.0 | 50 | 450 | 2.9 | Example |
| 33 | T | 1240 | 1120 | ○ | 900 | 1.5 | 50 | 470 | 2.9 | Comparative Example |
| 34 | U | 1210 | 1090 | — | 910 | 1.0 | 50 | 400 | 2.9 | Comparative Example |
| 35 | V | 1210 | 1100 | — | 920 | 1.0 | 50 | 430 | 2.9 | Comparative Example |
| 36 | W | 1200 | 1050 | — | 850 | 0.5 | 50 | 380 | 2.9 | Comparative Example |
| 37 | X | 1260 | 1040 | — | 930 | 1.5 | 50 | 450 | 2.9 | Comparative Example |
| 38 | Y | 1240 | 1130 | — | 950 | 1.0 | 50 | 400 | 2.9 | Comparative Example |
| 39 | Z | 1250 | 1130 | ○ | 880 | 1.0 | 50 | 520 | 2.9 | Example |
| 40 | AA | 1220 | 1110 | ○ | 930 | 0.5 | 50 | 500 | 2.9 | Example |
| 41 | AA | 1200 | 1090 | — | 910 | 1.0 | 45 | 470 | 3.2 | Example |
| 42 | AB | 1200 | 1080 | — | 890 | 1.5 | 50 | 470 | 2.9 | Example |
| 43 | AB | 1230 | 1120 | ○ | 900 | 1.0 | 45 | 440 | 3.2 | Example |

(*1) Time from completion of finish rolling to start of cooling (forced cooling)

(*2) Average cooling rate between finishing delivery temperature and coiling temperature

TABLE 3

| Hot-Rolled Steel Sheet No. | Steel | Microstructure of Hot-Rolled Steel Sheet: Average Aspect Ratio of Prior-γ Grains (*1) | Area Ratio (%) of Recrystallized Prior-γ Grains | Area Ratio (%) of Bainite Phase | Area Ratio (%) of MA Phase (*2) | Grain Diameter of MA Phase (μm) | Area Ratio (%) of F phase (*3) | Mass of Precipitates of Less Than 20 nm (mass %) | Mechanical Properties of Hot-Rolled Steel Sheet: Yield Point YP (MPa) | Tensile Strength TS (MPa) | Total Elongation El (%) | Hole Expansion Ratio (%) | Punching Workability | Note |
|---|---|---|---|---|---|---|---|---|---|---|---|---|---|---|
| 1 | A | 1.5 | 0 | 95 | 5 | 1.4 | — | 0.005 | 879 | 1010 | 14.3 | 74 | ○ | Example |
| 2 | A | 1.4 | 0 | 100 | 0 | — | — | 0.010 | 974 | 1059 | 13.7 | 83 | ⊙ | Example |
| 3 | A | 1.8 | 0 | 88 | 12 | 2.5 | — | 0.025 | 790 | 1000 | 16.1 | 64 | ○ | Example |
| 4 | A | 1.7 | 0 | 100 | 0 | — | — | 0.008 | 875 | 962 | 15.2 | 83 | ⊙ | C. Example |
| 5 | A | 10 | 0 | 77 | 3 | 1.6 | 20 | 0.010 | 955 | 1085 | 13.8 | 28 | X | C. Example |
| 6 | A | 1.15 | 75 | 70 | 0 | — | 30 | 0.020 | 868 | 965 | 16.5 | 23 | ○ | C. Example |
| 7 | A | 1.6 | 0 | 83 | 0 | — | 17 | 0.007 | 949 | 1031 | 14.5 | 34 | ○ | C. Example |
| 8 | B | 1.5 | 0 | 95 | 5 | 0.5 | — | 0.008 | 861 | 1001 | 16.6 | 79 | ○ | Example |
| 9 | B | 1.75 | 0 | 96 | 4 | 0.4 | — | 0.003 | 898 | 1026 | 15.5 | 88 | ○ | Example |
| 10 | C | 1.5 | 0 | 97 | 3 | 0.4 | — | 0.002 | 1085 | 1218 | 11.1 | 68 | ○ | Example |
| 11 | C | 1.35 | 5 | 0 | 100 | 23.2 | — | 0.001 | 1024 | 1366 | 9.2 | 16 | ○ | C. Example |
| 12 | D | 1.5 | 0 | 100 | 0 | — | — | 0.003 | 1018 | 1107 | 12.5 | 82 | ⊙ | Example |
| 13 | D | 10 | 0 | 100 | 0 | — | — | 0.010 | 1045 | 1161 | 11.4 | 60 | X | C. Example |
| 14 | E | 1.45 | 3 | 100 | 0 | — | — | 0.005 | 917 | 1019 | 14.8 | 76 | ⊙ | Example |
| 15 | F | 1.5 | 0 | 100 | 0 | — | — | 0.005 | 964 | 1060 | 13.1 | 91 | ○ | Example |
| 16 | F | 1.8 | 0 | 98 | 2 | 0.8 | — | 0.012 | 887 | 1008 | 13.6 | 82 | ○ | Example |
| 17 | G | 3.1 | 0 | 92 | 8 | 1.1 | — | 0.003 | 967 | 1185 | 12.1 | 66 | ○ | Example |
| 18 | H | 1.35 | 10 | 93 | 7 | 1.3 | — | 0.002 | 863 | 1043 | 15.9 | 62 | ○ | Example |
| 19 | I | 1.4 | 0 | 100 | 0 | — | — | 0.002 | 896 | 985 | 13.3 | 86 | ⊙ | Example |
| 20 | J | 1.5 | 0 | 96 | 4 | 0.6 | — | 0.004 | 1034 | 1182 | 11.9 | 67 | ○ | Example |
| 21 | J | 2.6 | 0 | 100 | 0 | — | — | 0.002 | 1133 | 1231 | 10.1 | 75 | ○ | Example |
| 22 | K | 4.1 | 0 | 100 | 0 | — | — | 0.003 | 1030 | 1120 | 12.3 | 68 | ○ | Example |
| 23 | K | 3.9 | 0 | 92 | 8 | 5.5 | — | 0.113 | 851 | 1042 | 16.2 | 24 | X | C. Example |

TABLE 3-continued

| Hot-Rolled Steel Sheet No. | Steel | Microstructure of Hot-Rolled Steel Sheet: Average Aspect Ratio of Prior-γ Grains (*1) | Area Ratio (%) of Recrystallized Prior-γ Grains | Area Ratio (%) of Bainite Phase | Area Ratio (%) of MA Phase (*2) | Grain Diameter of MA Phase (μm) | Area Ratio (%) of F phase (*3) | Mass of Precipitates of Less Than 20 nm (mass %) | Mechanical Properties of Hot-Rolled Steel Sheet: Yield Point YP (MPa) | Tensile Strength TS (MPa) | Total Elongation El (%) | Hole Expansion Ratio (%) | Punching Workability | Note |
|---|---|---|---|---|---|---|---|---|---|---|---|---|---|---|
| 24 | L | 1.55 | 0 | 95 | 5 | 0.6 | — | 0.003 | 880 | 1012 | 16.3 | 71 | ○ | Example |
| 25 | L | 1.45 | 3 | 97 | 3 | 0.4 | — | 0.002 | 911 | 1035 | 15.1 | 79 | ○ | Example |
| 26 | M | 2.6 | 0 | 95 | 0 | — | 5 | 0.004 | 1100 | 1196 | 13.1 | 62 | ○ | Example |
| 27 | N | 2.5 | 0 | 96 | 4 | 0.7 | — | 0.003 | 852 | 991 | 16.7 | 66 | ○ | Example |
| 28 | O | 4.5 | 0 | 93 | 7 | 1.2 | — | 0.015 | 1013 | 1191 | 12.6 | 62 | ○ | Example |
| 29 | P | 1.35 | 5 | 100 | 0 | — | — | 0.011 | 911 | 1013 | 14.2 | 76 | ⊙ | Example |
| 30 | Q | 2.6 | 0 | 89 | 11 | 1.3 | — | 0.002 | 879 | 1098 | 14.7 | 65 | ○ | Example |
| 31 | R | 1.8 | 0 | 90 | 10 | 1.4 | — | 0.003 | 980 | 1195 | 13.3 | 63 | ○ | Example |
| 32 | S | 1.4 | 3 | 95 | 5 | 0.9 | — | 0.005 | 853 | 992 | 15.1 | 72 | ○ | Example |
| 33 | T | 1.7 | 0 | 80 | 0 | — | 20 | 0.006 | 871 | 968 | 17.5 | 49 | ○ | C. Example |
| 34 | U | 1.4 | 0 | 83 | 17 | 1.8 | — | 0.002 | 857 | 1174 | 14.8 | 55 | ○ | C. Example |
| 35 | V | 1.8 | 0 | 100 | 0 | — | — | 0.002 | 871 | 968 | 15.3 | 57 | ⊙ | C. Example |
| 36 | W | 1.8 | 0 | 84 | 0 | — | 16 | 0.001 | 1010 | 1098 | 13.1 | 55 | ○ | C. Example |
| 37 | X | 1.05 | 100 | 80 | 0 | — | 20 | 0.001 | 849 | 934 | 17.6 | 56 | ○ | C. Example |
| 38 | Y | 7 | 0 | 95 | 5 | 0.8 | — | 0.012 | 1041 | 1225 | 12.5 | 64 | X | C. Example |
| 39 | Z | 1.8 | 0 | 86 | 14 | 2.6 | — | 0.023 | 827 | 985 | 14.6 | 64 | ○ | Example |
| 40 | AA | 1.6 | 0 | 88 | 12 | 2.2 | — | 0.038 | 854 | 993 | 13.5 | 68 | ○ | Example |
| 41 | AA | 1.85 | 0 | 92 | 8 | 1.4 | — | 0.010 | 906 | 1030 | 13.3 | 81 | ⊙ | Example |
| 42 | AB | 2.1 | 0 | 90 | 10 | 1.8 | — | 0.005 | 930 | 1057 | 13.1 | 72 | ⊙ | Example |
| 43 | AB | 1.75 | 0 | 95 | 5 | 0.5 | — | 0.003 | 974 | 1082 | 12.8 | 79 | ⊙ | Example |

(*1) prior-γ grains: prior-austenite grains
(*2) MA phase: martensite phase or martensite-austenite constituent
(*3) F phase: ferrite phase
C. Example: Comparative Example The hot-rolled steel sheets manufactured within the scope of the present disclosure were found to have tensile strengths of 980 MPa or more and be excellent in punching workability and hole expandability.

On the other hand, regarding Steel sheet No. 4, the cooling start time after completion of finish rolling was more than 2.0 s, and the tensile strength TS was less than 980 MPa. Regarding Steel sheet No. 5, the finishing delivery temperature was less than 830° C., prior-austenite grains had an average aspect ratio of more than 5.0, and the bainite phase had an area ratio of less than 85%; as a result, excellent hole expandability and punching workability were not achieved.

Regarding Steel sheet No. 6, the finishing delivery temperature was more than 950° C., recrystallized prior-austenite grains had an area ratio of more than 15%, and the bainite phase had an area ratio of less than 85%; as a result, the tensile strength TS was less than 980 MPa, and excellent hole expandability was not achieved. Regarding Steel sheet No. 7, the average cooling rate was less than 30° C./s, and the bainite phase had an area ratio of less than 85%; as a result, excellent hole expandability was not achieved.

Regarding Steel sheet No. 11, the coiling temperature (cooling stop temperature) was less than 300° C., the bainite phase had an area ratio of less than 85%, the martensite phase had an area ratio of more than 15%, and the martensite phase had an average grain diameter of more than 3.0 μm; as a result, excellent hole expandability was not achieved. Regarding Steel sheet No. 13, the finish rolling start temperature was less than 1000° C., and recrystallized prior-austenite grains had an average aspect ratio of more than 5.0; as a result, excellent punching workability was not achieved.

Regarding Steel sheet No. 23, the coiling temperature (cooling stop temperature) was more than 530° C., the martensite phase had an average grain diameter of more than 3.0 μm, and the amount of precipitates having a diameter of less than 20 nm was more than 0.10 mass %; as a result, excellent hole expandability and punching workability were not achieved. Regarding Steel sheet No. 33, the Mn content was less than 1.0 mass %, and the bainite phase had an area ratio of less than 85%; as a result, the tensile strength TS was less than 980 MPa, and excellent hole expandability was not achieved.

Regarding Steel sheet No. 34, the C content was more than 0.18 mass %, the bainite phase had an area ratio of less than 85%, and the martensite had an area ratio of more than 15%; as a result, excellent hole expandability was not achieved. Regarding Steel sheet No. 35, the Si content was less than 0.2 mass %; as a result, the tensile strength TS was less than 980 MPa, and excellent hole expandability was not achieved.

Regarding Steel sheet No. 36, the B content was less than 0.0005 mass %, and the bainite phase had an area ratio of less than 85%; as a result, excellent hole expandability was not achieved. Regarding Steel sheet No. 37, the Ti content was less than 0.02 mass %, prior-austenite grains had an average aspect ratio of less than 1.3, recrystallized prior-austenite grains had an area ratio of more than 15%, and the bainite phase had an area ratio of less than 85%; as a result, the tensile strength TS was less than 980 MPa, and excellent hole expandability was not achieved.

Regarding Steel sheet No. 38, the Ti content was more than 0.15 mass %, and prior-austenite grains had an average aspect ratio of more than 5.0; as a result, excellent punching workability was not achieved.

The invention claimed is:

1. A high-strength hot-rolled steel sheet having a composition consisting of:

C: 0.04% or more and 0.18% or less, by mass %;
Si: 1.14% or more and 2.0% or less, by mass %;
Mn: 1.0% or more and 3.0% or less, by mass %;
P: 0.03% or less, by mass %;
S: 0.005% or less, by mass %;
Al: 0.005% or more and 0.100% or less, by mass %;
N: 0.010% or less, by mass %;
Ti: 0.02% or more and 0.15% or less, by mass %;
Cr: 0.10% or more and 1.00% or less, by mass %;
B: 0.0005% or more and 0.0050% or less, by mass %; and
a balance being Fe and inevitable impurities, wherein the hot-rolled steel sheet has a microstructure including a bainite phase having an area ratio of 85% or more as a main phase, and a martensite phase or martensite-austenite constituent having an area ratio of 15% or less as a second phase, the balance being a ferrite phase, the second phase has an average grain diameter of 3.0 μm or less, prior-austenite grains in the steel sheet have an average aspect ratio of 1.3 or more and 5.0 or less, and recrystallized prior-austenite grains in the steel sheet have an area ratio of 15% or less relative to non-recrystallized prior-austenite grains in the steel sheet, the hot-rolled steel sheet contains precipitates having a diameter of less than 20 nm in an amount of 0.10% or less by mass %, the hot-rolled steel sheet has a tensile strength TS of 980 MPa or more, and at least eight holes of ten punched holes in each of ten 50 mm×50 mm sample sheets obtained from the hot-rolled steel sheet do not exhibit cracking, chipping, brittle fracture, or a secondary shear surface, where, as a punch, a ϕ20 mm flat-bottomed punch is employed, and a die-side hole diameter is determined such that a punching clearance is within 20%±2%, while the sample sheets are fixed from above with a sheet holder, a ϕ20 mm punched hole is formed, and after the punching is performed for each of the ten sample sheets, a state of fracture of punched edges of the punched holes is observed for their whole peripheries with a microscope with a magnification of 50× as to whether or not the cracking, chipping, brittle fracture, or secondary shear surface, is present.

2. A method for manufacturing the high-strength hot-rolled steel sheet according to claim 1, the method comprising:

heating a steel material at 1150° C. or more;

after heating the steel material, subsequently subjecting the steel material to hot rolling in which a finish rolling start temperature is 1050° C. or more and 1200° C. or less, and a finishing delivery temperature is 830° C. or more and 950° C. or less;

starting cooling of the steel material within 2.0 s from completion of the finish rolling in the hot rolling step, and performing the cooling at an average cooling rate of 30° C./s or more to a cooling stop temperature of 300° C. or more and 530° C. or less; and performing coiling at the cooling stop temperature.

3. The high-strength hot-rolled steel sheet according to claim 1, wherein the hot-rolled steel sheet has a total elongation EL in a range of 10.1 to 16.7%.

4. The high-strength hot-rolled steel sheet according to claim 1, wherein Si: 1.21% or more and 2.0% or less, by mass %.

* * * * *